United States Patent [19]

Paul

[11] Patent Number: 4,936,450

[45] Date of Patent: Jun. 26, 1990

[54] COMBINED SHIPPING AND DISPLAY MERCHANDISER

[75] Inventor: Gerald T. Paul, Whitelaw, Wis.

[73] Assignee: Newell Operating Company, Freeport, Ill.

[21] Appl. No.: 289,316

[22] Filed: Dec. 23, 1988

[51] Int. Cl.[5] ..... B65D 81/04

[52] U.S. Cl. ..... 206/386; 206/45.14; 206/499; 206/523

[58] Field of Search ..... 206/44 R, 45.11, 45.14, 206/45.19, 320, 386, 499, 521, 523, 553, 576, 585, 587, 593, 594, 814, 821; 217/26, 26.5, 27, 28, 35

[56] References Cited

U.S. PATENT DOCUMENTS

| | | | |
|---|---|---|---|
| 2,151,503 | 3/1939 | Dowst | 206/45.19 |
| 2,978,099 | 4/1961 | Bush | 206/44 R |
| 3,181,698 | 5/1965 | Knapp et al. | 206/564 |
| 3,432,026 | 3/1969 | O'Leary | 206/564 |
| 3,482,756 | 12/1969 | Collie | 217/26.5 |
| 3,517,868 | 6/1970 | Daughtry | 206/45.14 |
| 4,022,321 | 5/1977 | Barnett | 206/497 |
| 4,195,732 | 4/1980 | Bell | 206/593 |

FOREIGN PATENT DOCUMENTS

| | | | |
|---|---|---|---|
| 2418170 | 10/1979 | France | 206/593 |

*Primary Examiner*—Jimmy G. Foster

*Attorney, Agent, or Firm*—James G. Staples; David I. Roche

[57] ABSTRACT

The invention is embodied in a container which is used to both ship and display cookware such as frying pans. The container is made up of two identical trays which support opposite sides of parallel rows of pans. Each tray has two rows of cavities and a sloping section which support the pans in a compact array. The pans are held in a way which minimizes wasted space and which presents the pans in an attractive display when the upper tray is removed.

20 Claims, 1 Drawing Sheet

Fig.1.
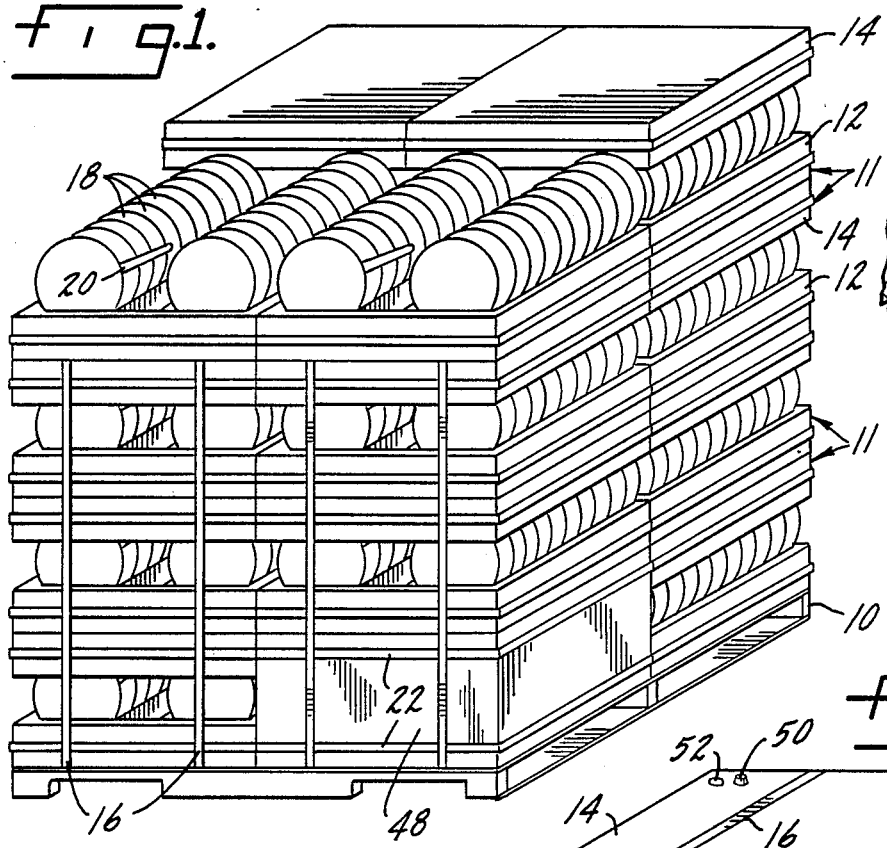
Fig.6.
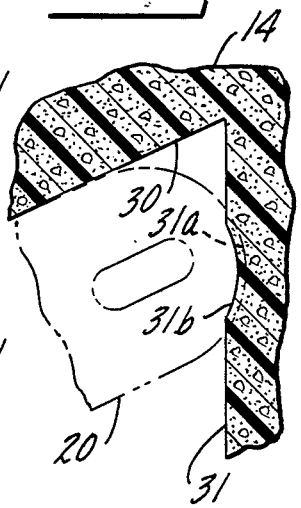
Fig.2.
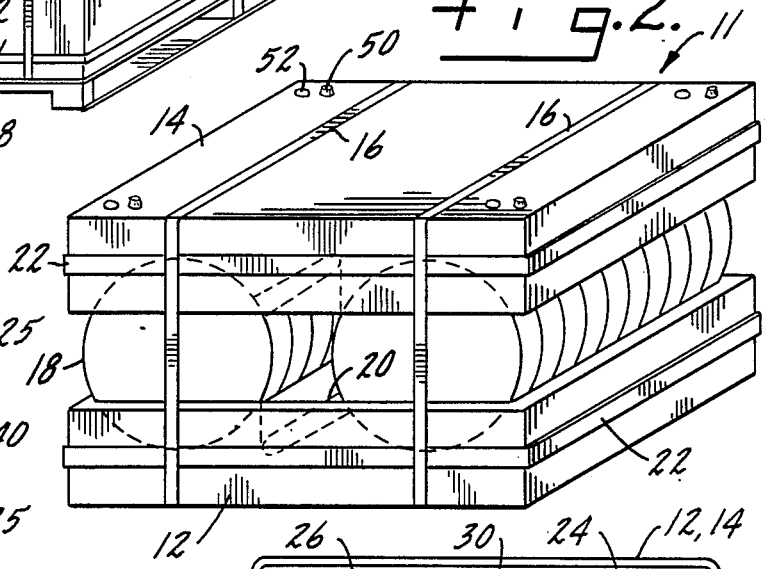
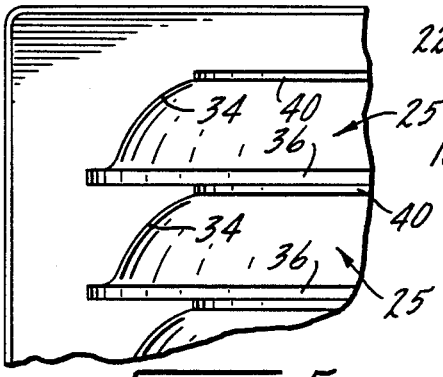
Fig.5.
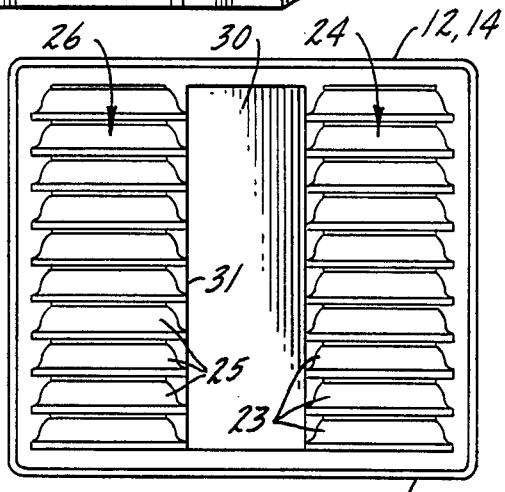
Fig.3.
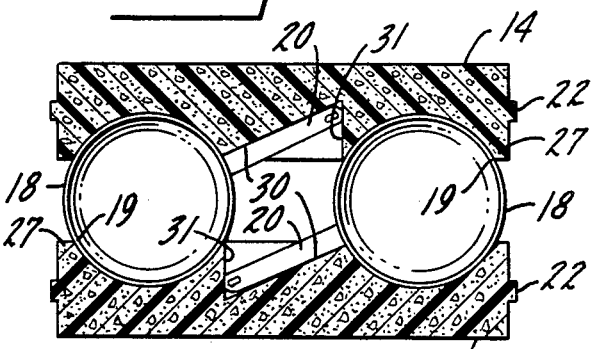
Fig.4.

COMBINED SHIPPING AND DISPLAY MERCHANDISER

BACKGROUND AND SUMMARY OF THE INVENTION

This invention relates to the shipping and displaying of bulky items such as cookware. In particular, the invention relates to a combined shipping and display device for frying pans.

The need for a shipping container which can also be used as a display has been brought about by the popularity of "warehouse" retail establishments and "outlet" stores. Such retail establishments do little shelving of products, and thereby save on labor related to handling merchandise. Instead, the merchandise is offered for sale directly from the containers in which they are shipped. Frequently, such merchandise will remain on pallets in a warehouse-type environment. Customers are allowed to roam the warehouse to select merchandise from the shipping/display containers. The cost saving which arises from the elimination of shelving labor is passed on, at least in part, to the customer.

Cookware having non-stick surfaces (such as those bearing the brandnames Silverstone and Teflon) presents particular problems in designing shipping/display packaging. Non-stick surfaces, in many cases, are relatively easily scratched. Therefore, items having such surfaces must be well supported and separated. At the same time, it is important to present the items to the purchasing public in a visually attractive, yet economical, way.

Frying pans, because of their elongated rigid handles, present a somewhat awkward shape for purposes of shipment and display. The handle makes stacking difficult, and the large amount of packaging material required to protect both the handle and the non-stick surface can be costly. Therefore, designing a package which is fully protective of the handle and cooking surfaces, which utilizes a minimum of packaging material, while displaying a major portion of the shipped products in an attractive way is a significant challenge.

Therefore, it is an object of the present invention to provide a package for shipping and displaying cookware which properly protects the cooking surfaces of the cookware.

Another object of the invention is to provide a package for shipping and displaying cookware in which handles of the cookware are protected.

Another object of the invention is to provide a package for shipping and displaying cookware which is cost effective.

Yet another object of the invention is to provide a package for shipping and displaying cookware which presents the cookware to the purchasing public in a visually attractive way.

Still another object of the invention is to provide a package for shipping and displaying cookware in which a large portion of the cookware is able to be seen.

These and other objects of the invention are achieved with a package made in accordance with the present invention. One embodiment of the invention includes a pair of substantially identical molded styrofoam trays, each having a plurality of pockets shaped to complimentarily engage opposite edges of a frying pan. Each of the trays has two rows of pockets separated by a sloping surface against which handles of pans in one row can rest. One of the trays acts as a base, and the other tray acts as a cover, with the two rows of pans sandwiched therebetween. Each base/cover combination can be banded to form an invertible unit, the units being shaped so that several units can be carried by a pallet to facilitate handling by a forklift. The palletized units can be opened quickly and easily, by customers if necessary, and are immediately ready for use as a display.

BRIEF DESCRIPTION OF THE DRAWINGS

FIG. 1 is a perspective view of palletized units of packages made in accordance with the present invention;

FIG. 2 is a perspective view of a single unit made in accordance with the present invention;

FIG. 3 is a plan view of a tray made in accordance with the present invention;

FIG. 4 is a sectional view taken through a central portion of a unit of the present invention;

FIG. 5 is an enlarged plan view of a portion of the tray shown in FIG. 3.

FIG. 6 is an enlarged view of the handle receiving portion of the tray of the present invention showing a handle in phantom.

DETAILED DESCRIPTION OF THE INVENTION

FIG. 1 shows a pallet 10 with four layers of units 11, each layer having four units. Each unit is comprised of a tray 12 and a cover 14. Each tray 12 has two rows filled with pans 18 which have handles 20. One of the units in the bottom layer includes a protective cardboard tube 48 held in position by ribs 22 formed on the tray and cover of that unit. The tube, not necessarily cardboard, protects the contents of the unit from exposure to dirt and other elements. Alternatively, the units 11 may be assembled without a protective tube, and the entire palletized load can be wrapped in stretch film. The tube 48 shown does not provide structural support, but rather, acts as a shield.

FIG. 2 shows a unit 11 with bands 16 holding the tray 12, pans 18, and cover 14 in a sandwich-like arrangement. The bands 16 extend around the unit 11 in the direction of the two rows of the pans 18. FIG. 2 also shows the invertible configuration of the tray 12 and cover 14. If the units 11 are turned over, each cover 14 will act as a tray, and similarly, each tray 12 will act as a cover, i.e. the trays 12 and covers 14 are identical and interchangeable. In the sandwich-like arrangement, the pans 18 engage the pockets 23 and 25, shown in FIG. 3, and act as columnar supports for units stacked above. Thus, the pans themselves are an integral and important packaging element. By using the pans as a structural element in the system, use of other packaging material is reduced, which results in cost savings.

FIG. 3 shows a plan view of an empty tray 12 (or cover 14). Each tray includes a plurality of pockets or cavities 23 and 25 arranged in rows 24 and 26, respectively. The rows 24 and 26 are separated by a large sloping center section for receiving the handles of the pans in row 24. A cover used in connection with the tray shown in FIG. 3 would have a similar sloping central section which would receive the handles of the pans in row 26. Four feet 50 are located on the cover 14 shown in FIG. 2. Next to the feet 50 are depressions 52 which engage the feet of a base placed on top thereof. The placement of the feet 50 and depressions 52 gives the palletized load stability to resist relative movement during both shipment and display. If a customer with a shopping cart bumps a unit, the interlocking of the feet and depressions will tend to keep the units in a neat nested stack.

The sectional views of FIG. 4 and the enlarged plan view of FIG. 5 clearly show the specific shape of the pockets 23 and 25, the shape being important in providing edge support to the pans 18 sufficient to enable them to act as structural components in the package and stacking arrangement. Each pocket is comprised of a plurality of arcuate surfaces. The surface 34 is generally spherical. A cylindrical surface 36 and a second cylindrical surface 40 are shaped to engage the top and bottom edges, respectively, of pans 18.

FIG. 4 shows the sandwiched relationship between the tray 12, the cover 14 and the pans 18. The vertical surface 31 prevents downward rotation of the handles 18 which are in the row 26. However, due to frictional engagement between the outside surfaces of the pans 18 and the pockets 25, removal of the cover 14 presents the pans 18 which are in row 25 in an inviting manner, i.e. with the handles projecting upwardly in a neatly appearing array. During shipment, engagement between the handles 20 and the surfaces 30 and 31 hold the pans in a substantially fixed position, further reducing the chances of damaging the nonstick surfaces of the pans.

Surfaces 30 and 31 form a crevice for receiving and tightly supporting the handles and therefore the pans during shipment. If a resilient material, such as expanded polystyrene, is used the handles 20 will resiliently deform the walls 30 and 31 of the sloping sections of the trays, causing a slight compression between the end of the handles 20 and the opposite outer ends 19 of the pans 18 at the upper outside ends 27 of the pockets 25. Such resilient gripping is increased when several layers of trays are stacked upon one another, because of the generally resiliently deformable nature of expanded polystyrene.

FIG. 6 shows the gripping action of the crevice formed by the walls 30 and 31. The pan handle 20 is shown with dotted lines in its as shipped position. The wall 31 has been deformed by generally axial movement of the handle 20. The depression **31*a* in the wall 31 is formed by the end of the handle 20. The resilient nature of the material comprising the cover 14 urges the handle against wall 30 and in the axial direction so that the outer portion 19 of the pan 18 (shown in FIG. 4) presses against the outside end 27 of the pocket containing the pan. The depression 31*b* is what remains of depression 31*a* after removal of the handle. The difference in size between depression 31*a* and 31*b* will depend upon the resilience of the material of the cover 14**. The resilient gripping action of this arrangement prevents damage during shipment to the handles, the non-stick surfaces, and the connections between the handles and the pan bodies.

The units 11 clearly show major portions of the product, with and without the covers 14 in position, and with the units on the same pallet by which they are transported. Therefore, there is no need for a clerk to handle the pans in order to prepare them for sale. The pallet needs only to be placed in a convenient location, and as products are sold, the trays can be put aside. Such an arrangement gives the pans a visibility which is equal to or better than the visibility afforded by a typical shelving arrangement without the costly labor and without the capital expense of providing the shelves initially. Furthermore, the labor expense of periodically keeping the shelves orderly is eliminated. Occasional removal of used packaging materials can be done by janitorial personnel.

The packaging arrangement of the present invention is not only more economical and convenient from a labor saving and point-of-purchase standpoint. The packaging arrangement is also more compact than conventional systems. Conventional systems can at best transport about 288 ten inch frying pans per pallet. Such systems use paperboard containers and styrofoam separators. However, with the package of the present invention, 320 ten inch frying pans can be shipped on the same sized pallet. Thus, without regard to the previously discussed advantage relating to protection and use as a display, from the standpoint of the number of pans it can accommodate the present invention is an improved shipper.

While the invention has been described with reference to a specific embodiment, it is apparent that numerous alternative, modifications, and variations will occur to those skilled in the art. Therefore, it is intended that all such alternatives, modifications, and variations be included within the spirit and scope of the appended claims.

We claim:

1. A package component for cookware comprising:

a tray-like base, pocket means formed in said base for support of said cookware on an edge thereof, said pocket means being comprised of at least one pair of rows of pockets, handle support means for preventing rotation of said cookware during shipment, said handle support means including sloping section, said component having a single sloping section for each of said pair of rows, whereby said tray-like base is invertible and capable of operating as a complementary cover in conjunction with another substantially identical tray-like base.

2. A package component for cookware of claim 1 further characterized in that the handle support means for preventing rotation of said cookware during shipment includes:

forming the tray-like base from a resiliently deformable material in at least the handle support area, whereby, when a unit of cookware is placed in the pocket means and the handle assumes its final resting position, said material will initially be resiliently deformed, and thereafter, after the handle has been removed, at least partially return towards its non-deformed position, said resiliently deformable material being insufficiently rigid to prevent substantial movement of the handle from its shipped position by forces applied during shipment.

3. A package for shipping and displaying frying pans comprising a plurality of rectangular molded tray-like bases dimensioned to fit nearly on a pallet, each of said bases having two rows of cavities for receiving and supporting frying pan bodies, and between said two rows a sloping section for receiving handles of pans in one of said rows, said sloping section extending from an upper portion of one row to a bottom portion of the other of said pair of rows, said cavities each having a shape complimentary to an edge of one of said frying pans, said cavities being shaped to support a frying pan and hold said frying pan on said edge, each of said tray-like bases having a complimentary cover substantially identical in shape to each of said bases, said bases and said covers forming sandwich-like units for engaging opposite edges of a plurality of frying pans.

4. A package for shipping and displaying frying pans in accordance with claim 3 wherein:

each of said units is held together by a pair of bands, each said band extending around said unit in a direction corresponding to an axis of one of said rows.

5. A package for shipping and displaying frying pans in accordance with claim 3 wherein:

said plurality is comprised of sets of four, each set stacked vertically upon a pallet.

6. A package for shipping and displaying frying pans in accordance with claim 3 wherein:

said plurality is comprised of sets of two rows, said sets stacked vertically upon one another on a pallet.

7. A package for shipping and displaying frying pans in accordance with claim 3 wherein:

said tray-like bases are stacked upon a pallet and attached to said pallet by a substantially transparent wrapping.

8. A package for shipping and displaying frying pans in accordance with claim 3 wherein:

grooves are formed in said covers and frying pans carried by lower tray-like bases engage and are supported by said grooves in said covers.

9. A package for shipping and displaying frying pans in accordance with claim 3 wherein:

said bases and said covers each have grooves formed therein;

said grooves having shapes corresponding to opposite edges of frying pans carried by said bases, said grooves cooperating with said frying pans to maintain said frying pans on their edges and said frying pans acting as columnar supports for upper tray-like bases and covers.

10. A package for shipping and displaying frying pans in accordance with claim 3 wherein:

said bases and covers each have a rib extending at least partially around the periphery thereof.

11. A package for shipping and displaying frying pans in accordance with claim 10 wherein:

a tubular protective element extends between ribs of complimentary bases and covers to protect said pans from exposure to dirt.

12. A package for shipping and displaying frying pans in accordance with claim 3 wherein:

each of said bases and covers has a central cavity comprising a sloping surface and a vertical surface, vertical surface cooperating with cavities of a complimentary base to prevent rotation of said frying pans and for positioning handles of said pans for display after removal of said cover.

13. A package component for use in shipping and displaying cookware comprising:

a tray-like element capable of operating alternatively as a base and a cover for a sandwich-like arrangement, said tray-like element including a plurality of pockets for receiving a portion of a piece of cookware in a close-fitting relationship, said plurality of pockets arranged in rows, each row being separated by a sloping section, said sloping section being comprised of a sloped surface and a generally vertical surface, said sloping section providing means for preventing said cookware from moving during shipment and for presenting said cookware in a neat display after shipment has been completed, said sloping section being centrally disposed along a central axis of said component to enable said sloping section to support handles of cookware held in a substantially identical opposite facing component.

14. A package component for use in shipping and displaying cookware in accordance with claim 13 wherein:

said package includes laterally protruding means disposed on outer surfaces of said package.

15. A package component for use in shipping and displaying cookware in accordance with claim 14 wherein said package further includes:

tubular cover means shaped to be held in position by said protruding means.

16. A package component for cookware in accordance with claim 13 wherein:

said pocket means are arranged in two rows, only one of which has a corresponding sloping section.

17. A package component for cookware in accordance with claim 13 wherein:

said sloping section forms a substantially continuously longitudinal opening extending from one end of said tray-like base to an opposite end thereof.

18. A package for shipping and displaying frying pans comprising a plurality of rectangular molded tray-like bases dimensioned to fit neatly on a pallet, each of said bases having two rows of cavities for receiving and supporting frying pan bodies, and between said two rows a sloping section for receiving handles of pans in one of said rows, said sloping section extending from an upper portion of one row to a bottom portion of the other of said pair of rows, said cavities each having a shape complimentary to an edge of one of said frying pans, said cavities being shaped to support a frying pan and hold said frying pan on said edge, each of said cavities comprising a plurality of arcuate surfaces, said plurality including first and second arcuate surfaces which are generally spherical, and third and fourth arcuate surfaces which are generally cylindrical, and a fifth surface which is generally planar, said planar fifth surface being substantially perpendicular to said cylindrical third and fourth surfaces.

19. A package for shipping and displaying frying pans in accordance with claim 18 wherein:

said planar fifth surface is adjacent to and on opposite sides of said cylindrical surfaces forming a groove for holding a lip of one of said frying pans.

20. A package for shipping and displaying frying pans comprising a plurality of rectangular molded tray-like bases dimensioned to fit neatly on a pallet, each of said bases having two rows of cavities for receiving and supporting frying pan bodies, and between said two rows a sloping section for receiving handles of pans in one of said rows, said sloping section extending from an upper portion of one row to a bottom portion of the other of said pair of rows, said cavities each having a shape complimentary to an edge of one of said frying pans, said cavities being shaped to support a frying pan and hold said frying pan on said edge, said tray-like bases are stacked vertically and frying pans lying down in grooves formed in lower bases act as column-like supports for upper tray-like bases.

* * * * *